US006165269A

United States Patent [19]

Kathe

[11] Patent Number: 6,165,269

[45] Date of Patent: Dec. 26, 2000

[54] HARDWARE PAINT PROTECTORS

[76] Inventor: Robert D. Kathe, 2447 W. Knowles, Mesa, Ariz. 85202

[21] Appl. No.: 08/853,177

[22] Filed: May 7, 1997

[51] Int. Cl.[7] ..... B05C 11/11

[52] U.S. Cl. ..... 118/505; 118/504

[58] Field of Search ..... 118/505, 504, 118/301; 16/251, DIG. 40, 250; 174/67; 439/135; 200/333; 150/155; 427/282, 401; D7/6

[56] References Cited

U.S. PATENT DOCUMENTS

| | | | |
|---|---|---|---|
| 2,342,453 | 2/1944 | Colucci . | |
| 3,556,571 | 1/1971 | Laub, Jr. . | |
| 3,722,470 | 3/1973 | Farrell | 150/155 |
| 4,195,590 | 4/1980 | Herrington | 118/505 |
| 4,327,663 | 5/1982 | Izzo | 118/505 |
| 4,570,291 | 2/1986 | Smith | 16/250 |
| 4,656,058 | 4/1987 | Stark | 118/505 |
| 4,691,409 | 9/1987 | Torgerson et al. | 118/505 |
| 4,695,486 | 9/1987 | Stark | 118/505 |
| 4,791,007 | 12/1988 | Gleason | 118/505 |
| 4,796,330 | 1/1989 | Ziegler | 16/251 |
| 5,056,191 | 10/1991 | Love | 16/251 |
| 5,198,031 | 3/1993 | Derstine | 118/505 |
| 5,224,240 | 7/1993 | Smith et al. | 118/505 |
| 5,285,014 | 2/1994 | Gilchrist | 118/505 |
| 5,432,979 | 7/1995 | Harper | 16/251 |

*Primary Examiner*—Brenda A. Lamb
*Attorney, Agent, or Firm*—The Halvorson Law Firm

[57] ABSTRACT

The present invention is a masking system or kit which protects door and room hardware from contamination during the painting and other similar processes. These are a variety of mask described, each of which protects a different piece of hardware, such as door hinges, door knobs, dead bolts, and wall electrical outlets and switches. The masks work in combination to protect all of these items, but may be used individually. The masks of the present invention are reusable, but are cheap enough to manufacture that they may be disposable. A unique feature of many of the mask embodiments of the present invention is a tapered cross section which creates a fine edge which closely fits into the join between the hardware and the door or wall.

8 Claims, 9 Drawing Sheets

HARDWARE PAINT PROTECTORS

FIELD OF THE INVENTION

The present invention relates to the field of door and room hardware protection devices. These devices protect the hardware from foreign contamination during building construction or redecoration. More specifically, the present invention relates to protective devices for mask door and room hardware while painting, staining, varnishing or like processes.

BACKGROUND

During the construction or redecoration of a building interior rooms are finished or refinished by processes such as painting, lacquering, varnishing, staining or the like. These processes, upon consideration of the large flat surfaces normally found in a room, appear to be a quick and simple job. However, there are many features, such as door hardware and wall electrical hardware, which must be protected or masked from contamination by these process. The masking of these features is an especially time consuming and tedious process.

Usually, a painter or finisher will cover the hardware with numerous small pieces of masking tape to protect it from unwanted contamination. Excess masking tape is pruned using a sharp knife or razor blade. The application and pruning of the masking tape is considerably time consuming and, if the painter is not meticulous when pruning, useless because the hardware still becomes contaminated. Furthermore, removing all of the applied masking tape is another slow tedious process.

Many individuals, especially amateur household painters, omit masking the hardware features and either paint over or adjacent the hardware feature. If the hardware feature is painted, then the individual must spend extra time removing the unwanted paint. If the individual paints adjacent the hardware feature, then the painter must still spend extra time with a detail brush painting missed areas, and still may contaminate the hardware feature.

Many commercial painters and finishers will bid projects out on a fixed fee basis. Thus, the faster the commercial painter can finish a job, the higher the profit margin. In order to maximize their profit margin, commercial painters may skimp on the meticulous preparation currently necessary for masking the hardware features. The result of this practice is inferior quality services in which paint contaminates the hardware features or the wall is not completely covered.

Thus, it is recognized that there is a need for devices which provide quick and easy masking of room and door features for painting, varnishing lacquering, staining and other processes. The prior art reveals several examples of devices which attempt to alleviate this problem of protection door and room hardware.

In U.S. Pat. No. 4,691,409 issued to Torgerson et al., an elastic door hinge mask is disclosed which stretches to cover a door hinge pin barrel. The first disclosed embodiment of Torgerson uses an elastic body which resembles an inflatable balloon with a slit. Attached near one end of the slit in the elastic body is a covering flap with securing hooks at the distal end of the covering flap. The door hinge pin barrel is inserted within the elastic body, through the slit, and the covering flap is pulled around to cover the opposite side of the pin barrel. The securing hooks attach to the door hinge butt plates and secure the covering flap into place. The securing hooks may be replaced with a securing loop to perform the same function. Alternately, the elastic body of the Torgerson invention may be in the shape of a hood or cowl. The closed end of the cowl shaped elastic body is placed over one end of the pin barrel and the device is stretched around a second end of the pin barrel and up the opposite side. A securing strap is attached to an open neck end of the cowl shaped elastic body and wraps around the first end of the pin barrel thereby securing the elastic body around the hinge pin barrel. Finally, the Torgerson device may be a single rectangularly shaped elastic body with a first strap being attached close to a first end of the elastic body and a second strap being attached in an offset position from a second, opposite end of the elastic body. The first strap attaches to a first end of the pin barrel, the elastic body wraps around the pin barrel, and the second strap secures the entire device to the first end of the pin barrel. The Torgerson devices are fine for protecting the door hinge pin barrel, however, they cannot protect the remainder of the door hinge, the butt plate. Moreover, other items of door and room hardware need to be protected. Thus, there is a continuing need for devices which protect more than the door hinge pin barrel.

U.S. Pat. No. 5,056,191, issued to Love, discloses a door hinge paint mask which is designed to protect both the pin barrel and the butt plates of a door hinge. The Love device is primarily a thin flat rectangular piece with projecting tabs at top and bottom ends. An adhesive on an underside of the rectangular piece attaches the mask to the door hinge. The rectangular section completely covers the hinge butt plate without overlap onto the surface to be painted. The projecting tabs secure the device by wrapping over the ends of the door hinge pin barrel. Furthermore, the Love masks include score lines which allow the mask to be separated into subparts to cover the back side of the door hinge pin barrel. The Love device cannot easily be used to mask and protect other pieces of room and door hardware.

U.S. Pat. No. 5,198,031 issued to Derstine discloses two piece masking system for door hinges. A first mask protects the door hinge butt plate, while a second mask protects the door hinge pin barrel. The first mask is a magnetically attached flexible, rectangular section which includes a tab to remove the mask after the painting is finished. The second mask is an elongated mask with a substantially horseshoe shaped cross section. One end of the second mask is capped to both secure the mask to the pin barrel and protect the top of the pin barrel during painting. The opposite end is open to allow entrance of the pin barrel when mounting the second mask. It can be seen that the Derstine masking system is complex and expensive to manufacture. Thus, there is a continuing need for devices which simplify the masking of door and room hardware.

While the above discussed devices are designed to be used in situ, or with the door hung on the door hinge, there are devices which are designed to protect portions of the door hinge with the door removed from the frame.

U.S. Pat. No. 5,224,240 issued to Smith et al. teaches a single mask molded from a rigid thermoplastic resin. The Smith mask has a first section which protects the door hinge pin barrel and a second section which is flexibly attached and which protects door hinge butt plates. The first section is a bifurcated enclosure with the two parts flexibly hinged together and the second section is merely a rectangular cover for the butt plates. The removal of the door from the frame makes use of the Smith device a time consuming process, especially when coupled with the need to re-hang the door after the painting is finished.

U.S. Pat. No. 5,432,979 to Harper discloses a rigid protector with an open tubular first section and an attached rectangular second section. The user simply slides the open end of the first section over the top of the pin barrel and aligns the second section over the butt plate.

It can be seen from the above discussion of the background and examples of prior art in the field, that there is a continuing need for new and improved means for protecting door and room hardware during painting and other like processes.

SUMMARY OF THE INVENTION

It is an object of the present invention to provide a series of devices which protects various features of doors and room hardware during painting and refinishing processes.

It is a further object of the present invention to provide a device which protects door hinges during painting and other like processes.

It is a still further object of the present invention to provide a device which protect door hinge pin barrels during painting and other like processes.

It is still yet a further object of the present invention to provide a device which protects door hinge butt plates during painting and other like processes.

It is another object of the present invention to provide a first device which works in combination with a second device, wherein the first device protects door hinge butt plates from paint contamination and the second device protects door hinge pin barrels during painting and other like processes.

It is yet another object of the present invention to provide a device which protect dead bolt hardware during painting and other like processes.

It is still yet a further object of the present invention to provide a device which protects door knobs during painting and other like processes.

It is another object of the present invention to provide a device which protects electrical wall outlets during painting and other like processes.

It is still yet another object of the present invention to provide a device which protects lighting and other electrical switches during painting and other like processes.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DESCRIPTION OF PREFERRED EMBODIMENTS

The present invention is useful for protecting various door and room hardware from paint contamination during the painting and refinishing process. The various embodiments of the present invention, herein disclosed, protect a variety of different items of hardware. One form of the disclosed embodiments fits snugly over the pieces of hardware and has a fine, tapered edge which fits closely into the junction between the piece of hardware and the door or wall. The present invention may be more fully understood by the below discussion and reference to the drawings.

Figure 1A:
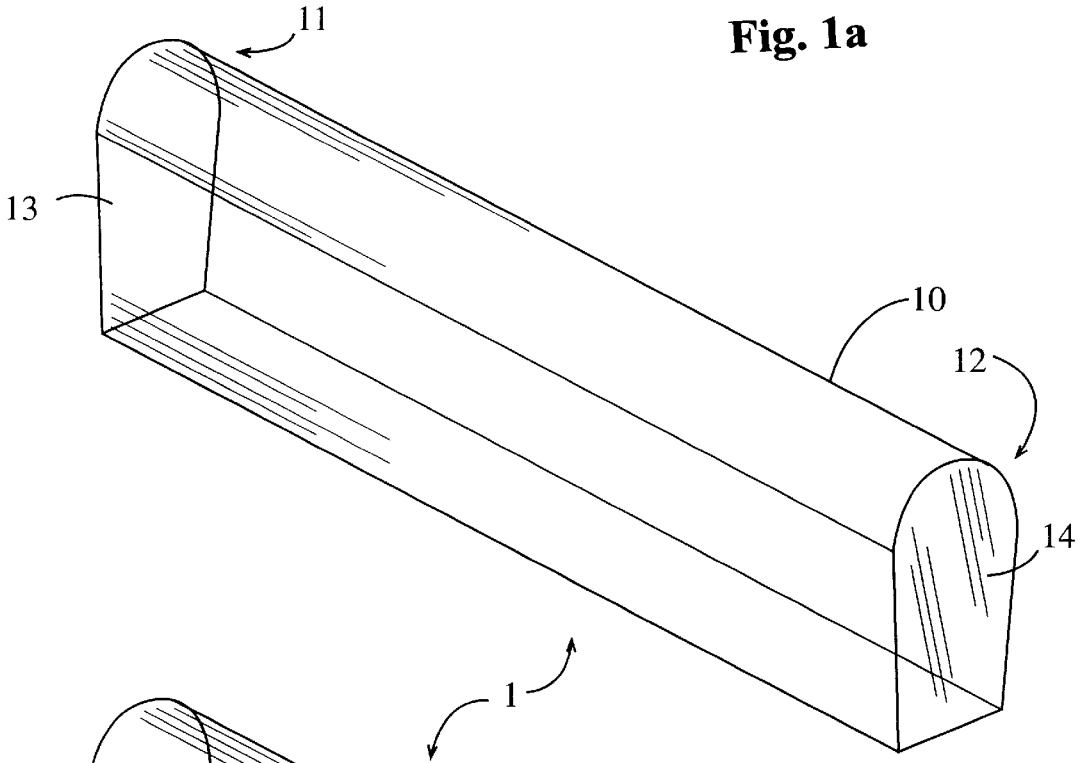
FIG. 1*a* is a perspective the device of the present invention which protects the door hinge pin barrel from paint contamination.
Figure 1B:
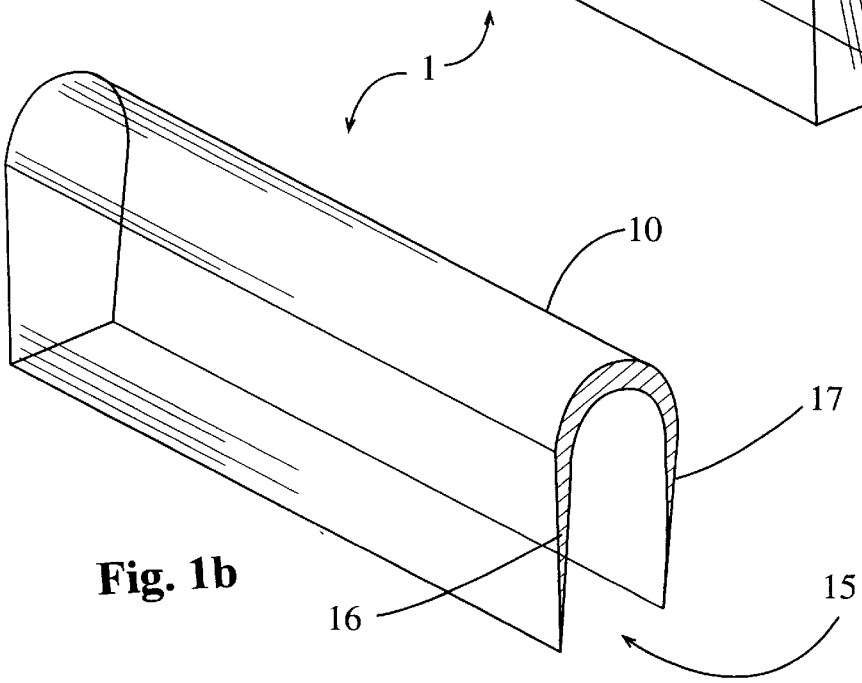
FIG. 1*b* is a cross sectional view of the embodiment shown in FIG. 1*a;*

In a first embodiment of the present invention, as seen in FIG. 1, mask 1 is a device which protects door hinge pin barrels. The mask 1 comprises a longitudinal section 10 with a door hinge pin barrel channel 15. The door hinge pin barrel channel 15 is defined by opposite arms, 16 and 17, which are attached at proximate ends thereof. The longitudinal section 10 has a first end 11 and a second end 12. Preferably the longitudinal section 10 has a substantially U-shaped cross section, however, the cross section may be V-shaped or other any other suitable shape which provides the pin barrel channel 15. First and second end pieces, 13 and 14, are adapted to conform and cap the first and second ends, 11 and 12, respectively, e.g., they are substantially D-shaped when the longitudinal section 10 has a U-shaped cross section and attach to the first and second ends, 11 and 12.

As can be seen in FIG. 1, the thickness of the cross section of the longitudinal section 10 tapers from where the arms 16 and 17 join to a fine edge at distal ends of the arms 16 and 17. This tapering of the cross section is critical to this embodiment since it provides the fine edge which is critical to a close fit in the join between the hardware and the door. Likewise, the first and second end sections, 13 and 14, are also tapered to a fine edge for the same close fit necessary for this embodiment of the present invention.

The first embodiment may be manufactured of a clear, flexible plastic by all traditional thermoplastic methods, however, injection molding is preferred. Furthermore, the clear, flexible plastic allows the painter to ensure the proper seating of the mask 1 around the door hinge pin barrel.

In use, the painter will place the mask 1 over the door hinge pin barrel. This is accomplished by placing the pin barrel at the opening of the channel 15 and forcing the pin barrel into the channel 15. The fine edges of the arms 16 and 17 then are seated into the join between the pin barrel and the door. The painter may they paint up to and including the mask without fear of contaminating the protected portion of the pin barrel.

Figure 2A:
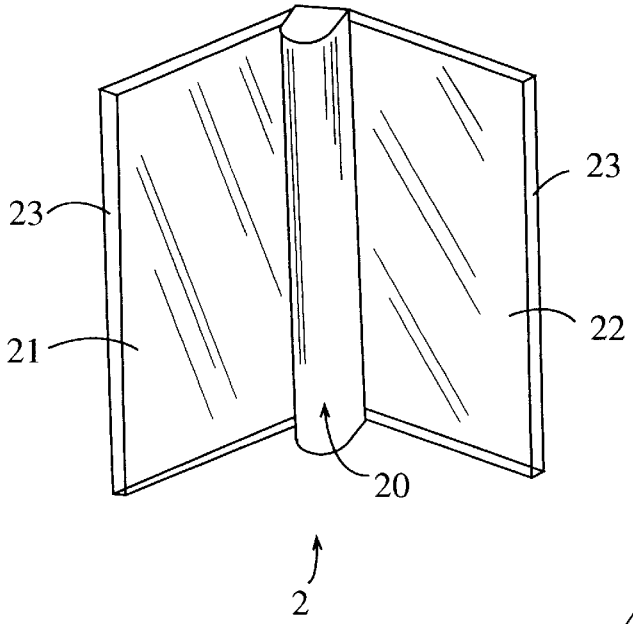
FIG. 2*a* is a perspective of the device of the present invention which protects the door hinge butt plates from paint contamination.
Figure 2B:
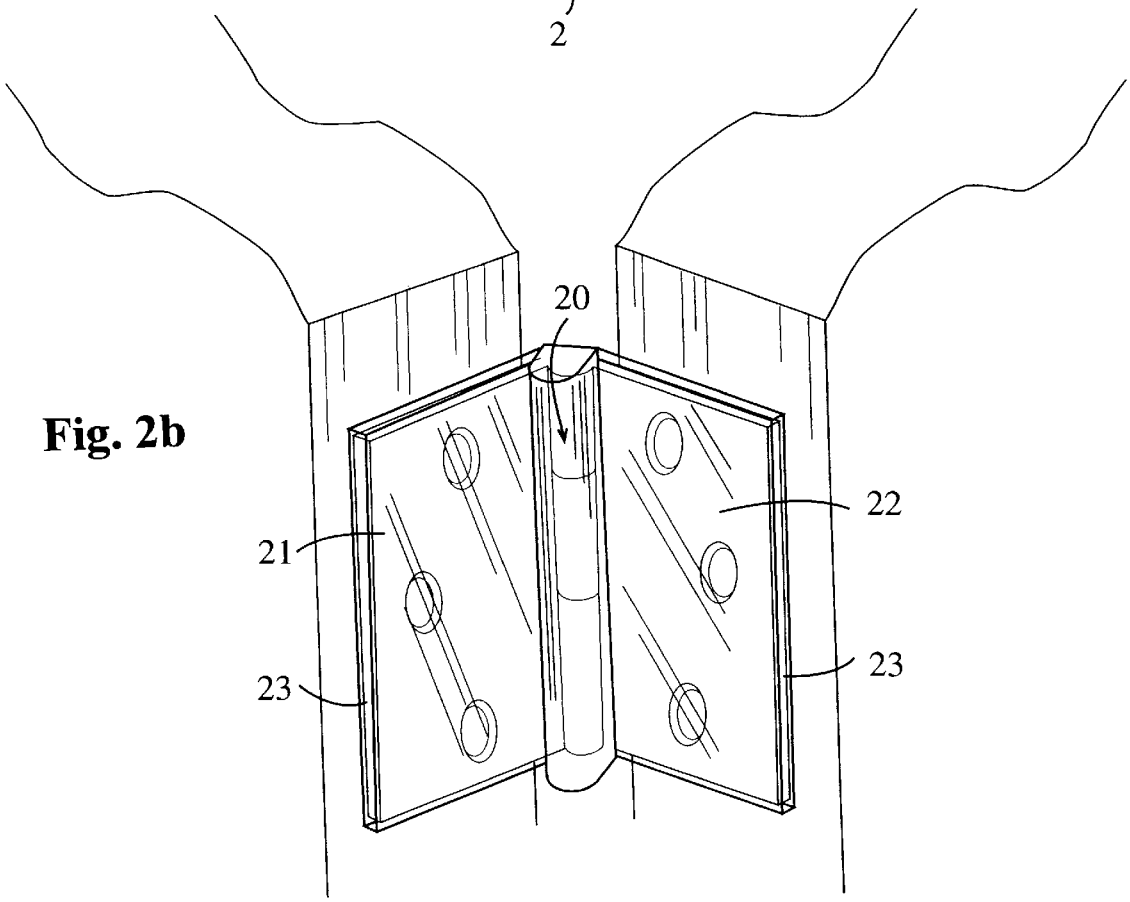
FIG. 2*b* depicts how the embodiment shown in FIG. 2*a* fits over a door hinge butt plate.

In a second embodiment of the present invention, as seen in FIG. 2, mask 2 is a device which protects door hinge butt plates. The mask 2 comprises a longitudinal section 20 which provides an enclosure 25 for a back side of the pin barrel and has flexibly attached first and second butt plate covers, 21 and 22, respectively. It is critical that the longitudinal section 20 provide the enclosure 25 and end caps 26 for preventing paint to travel down the ends. The longitudinal section 20 is preferably substantially U-shaped in cross section, though suitable alternative shapes are deemed to fall within the scope of the present invention.

The first and second butt plate covers, 21 and 22, are flexibly attached adjacent the enclosure 25 opening along opposite long sides of the longitudinal section 20 and are adapted to completely cover the hinge butt plates, e.g., rectangularly shaped. Attached to each of the first and second butt plate covers, 21 and 22, is a substantially perpendicular flange 23 which projects in the direction of the opening in the enclosure 5 and which tapers to a fine edge. The first and second butt plate covers, 21 and 22, are flexibly attached to the longitudinal section by any suitable flexible means, but, preferably, is attached by an integrally formed "living hinge".

Like mask 1, mask 2 may be manufactured of a clear, flexible plastic by all traditional thermoplastic methods, however, injection molding is preferred. Furthermore, the clear, flexible plastic allows the painter to ensure the proper seating of the mask 2 around the door hinge pin barrel.

Figure 3A:
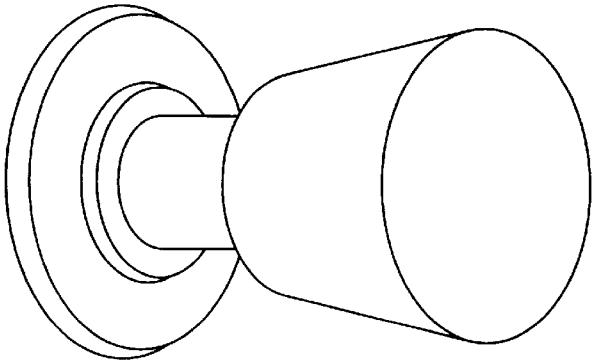
FIG. 3*a* and FIG. 3*b* illustrate how the device which protects dead bolt hardware fits over and protects the dead bolt hardware.
Figure 3A:
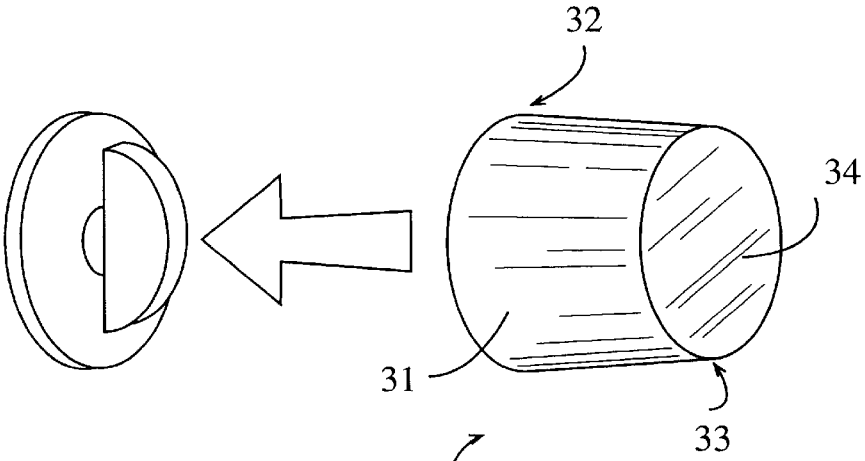
Figure 3B:
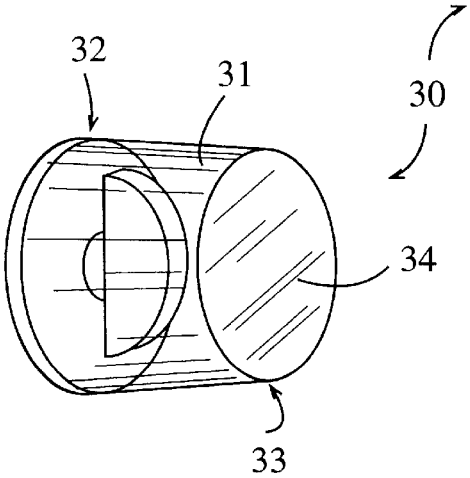

In a third embodiment of the present invention mask 3, as seen in FIG. 3, is a device which protects dead bold hardware. The mask 3 comprises a substantially cup shaped body 30 which has a substantially cylindrically shaped side wall 31 and a first end 32 which is open and a second end 33 which is capped by an end piece 34. The substantially cylindrically shaped side wall 33 preferably has the shape of a frustum, as shown in FIG. 3. The first end 31 of the frustum shape has a wider diameter than that of the second end 32. Similar to the previously described embodiments, the thickness of the side wall 33 also tapers from the first end 31 to the second end 32 to form a fine edge at the first end 31. It is critical that the diameter of the first end be adapted to fit around dead bolt hardware such that the fine edge at the first end 31 fits into the join between the dead bolt and the door.

Figure 4A:
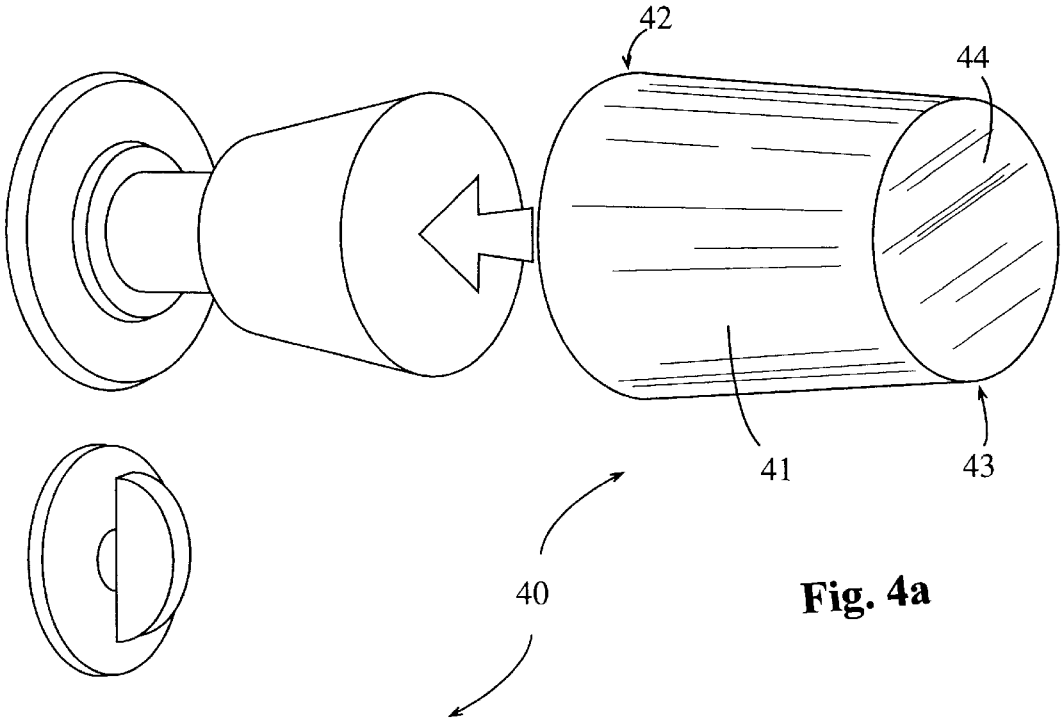
FIG. 4*a* and FIG. 4*b* illustrates how the device which protects door knobs fits over and protects the door knob.
Figure 4B:
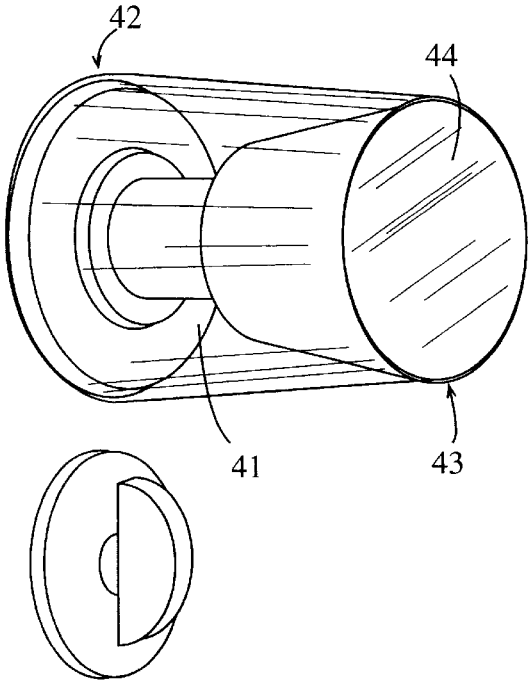

In a fourth embodiment of the present invention, as seen in FIG. 4, mask 4 is a device which protects door knobs. The mask 4 comprises a body 40 which is preferably substantially cup shaped, though it may be formed into other shapes in order to protect door handles and the like. The preferred embodiment of the body 40 has a substantially cylindrically shaped side wall 41 and an open first end 42 and a second end 43 which is covered by an end piece 44. FIG. 4 illustrates the body 40 having the shape of a frustum The frustum shape, as is shown in FIG. 4, has first end 41 with a wider diameter than that of the second end 42. The thickness of the side wall 43 is also tapered from the second end 43 toward the first end 42 to form a fine edge at the first end 41. The diameter of the first end is preferably adapted to fit around the door knob such that the fine edge formed by the tapering of the side wall thickness fits into the join between the door knob base plate and the door.

Figure 5:
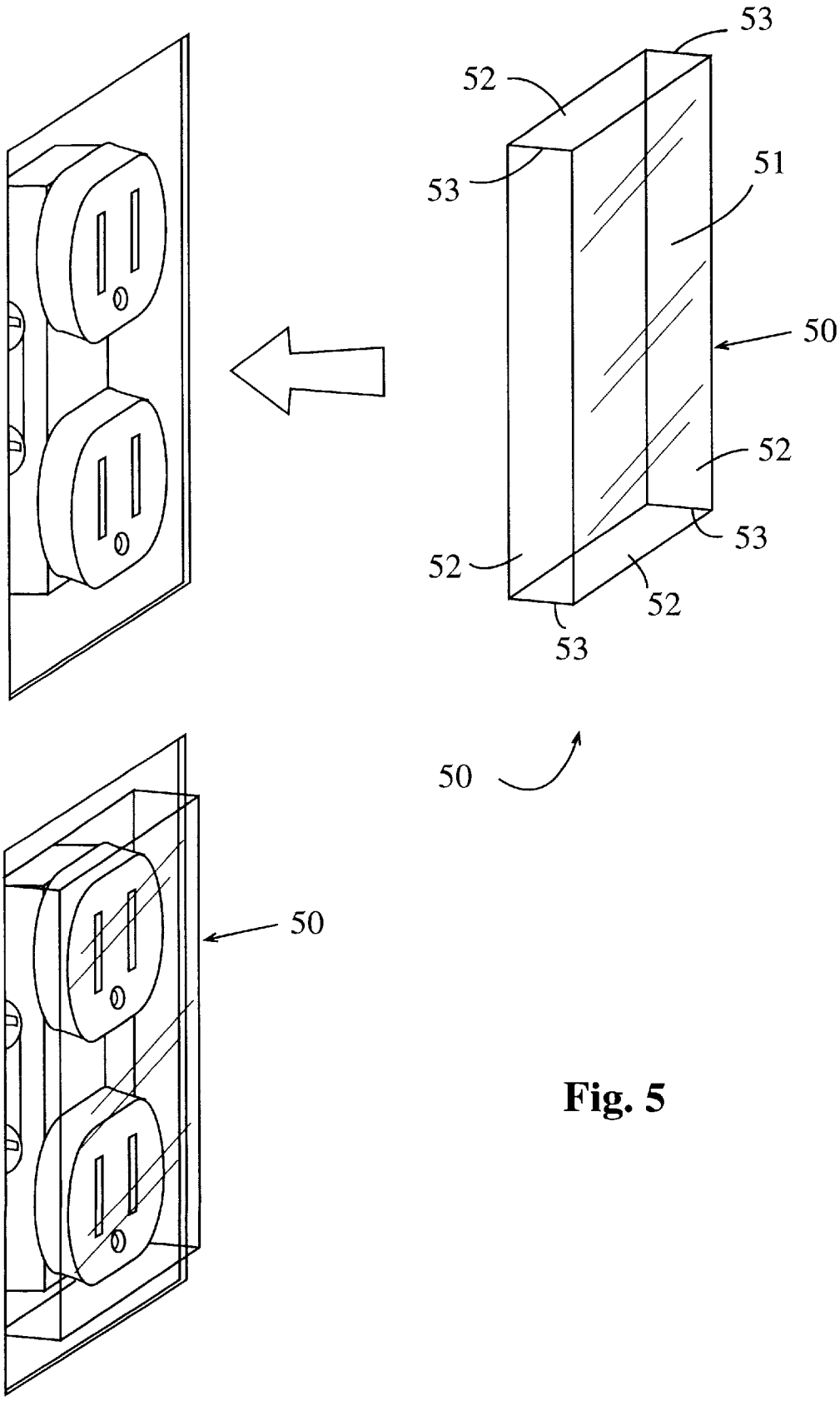
FIG. 5 illustrates a first form of a device which protects wall electrical hardware from paint contamination fits over the wall electrical hardware.

In a fifth embodiment of the present invention, as seen in FIG. 5, mask 5 is a first form of a device which protects wall electrical hardware. The mask 5 is a one piece cover 50 that is formed in the shape of an open box having a rectangular flat front 51 and four sides 52 which are attached along all four edges of the flat rectangular front 51 and join together at converging corners 53. The face plate of the wall electrical hardware is removed by unscrewing the securing screw. The remaining exposed wall electrical hardware is protected by snugly fitting the mask 5 over the electrical hardware or securing it with an adhesive 55.

An alternate form of this fifth embodiment of the present invention is a simple rectangularly shaped piece 54 which is dimensioned slightly smaller than an electrical outlet box. An attachment means 55, such as a pressure sensitive adhesive, is affixed to one side of the rectangularly shaped piece 54. A cover sheet 56 is provided to protect the pressure sensitive adhesive 55 prior to use and is placed on the pressure sensitive adhesive 55 such that the adhesive 55 is sandwiched between the rectangularly shaped piece 54 and the cover sheet 56. It can be seen that the above described two forms of the fifth embodiment may be adapted to be used with any size of electrical wall outlet.

Figure 6:
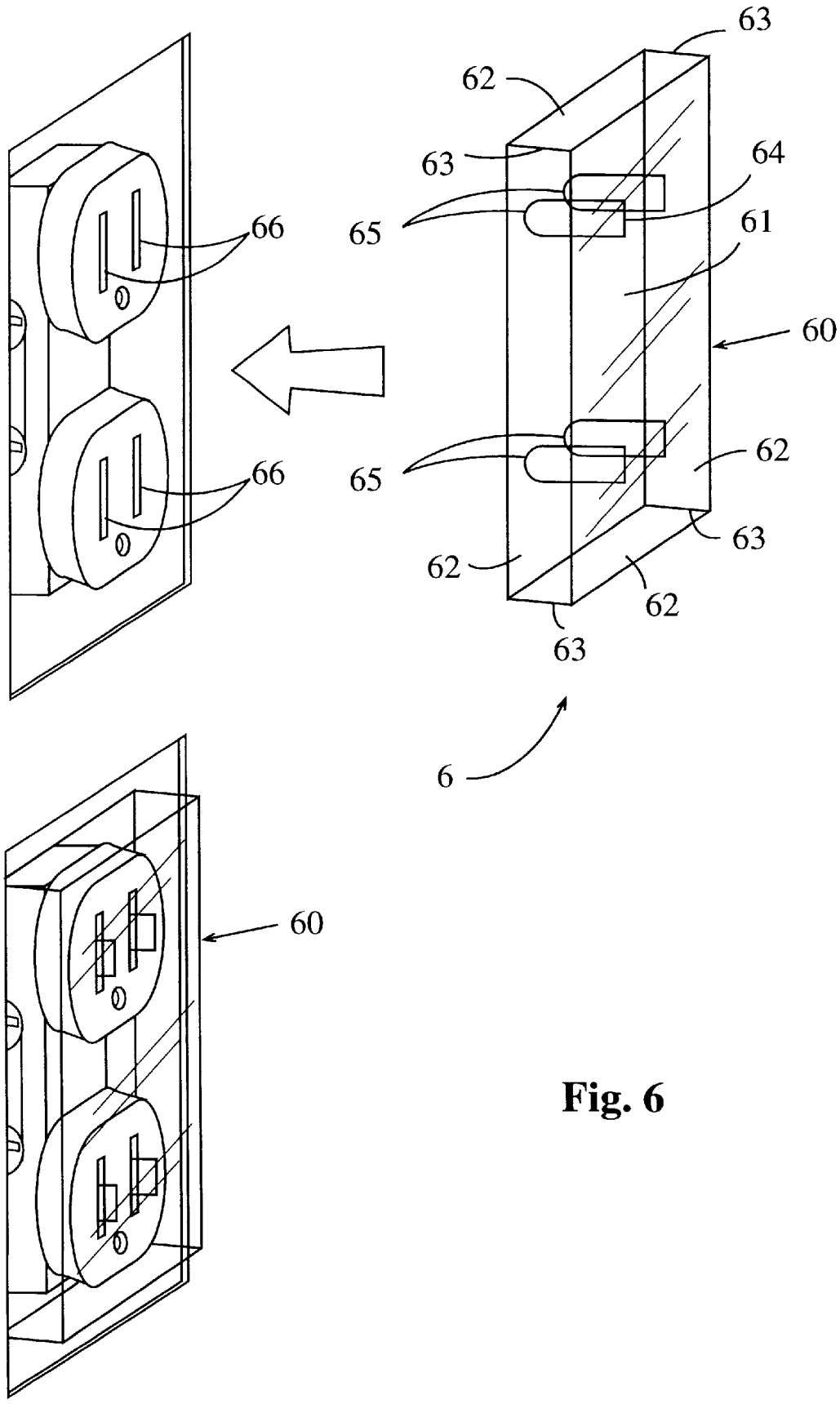
FIG. 6 illustrates a second form of a device which protects wall electrical hardware from paint contamination fits over the wall electrical hardware.
Figure 7:
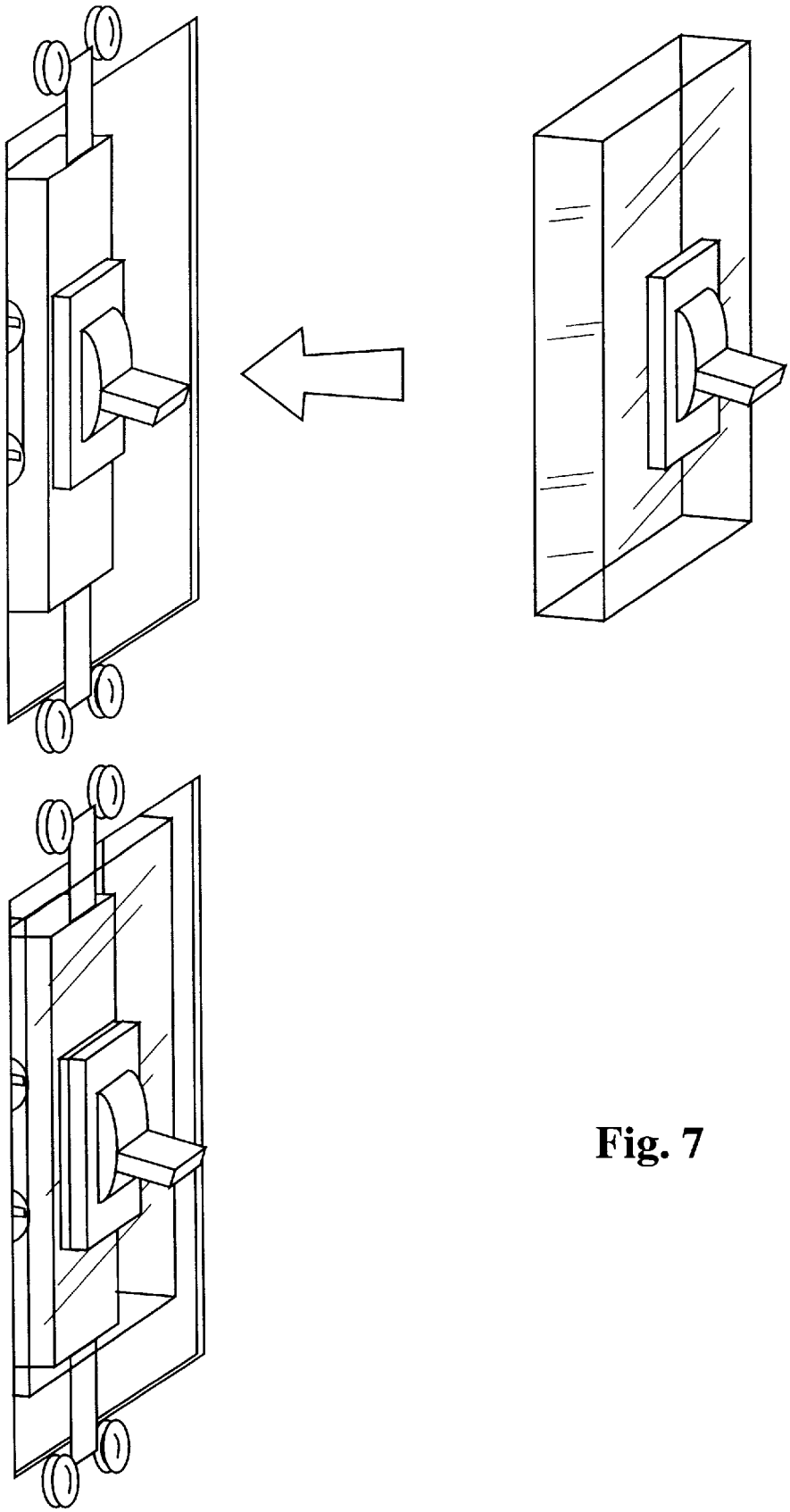
FIG. 7 illustrates a device which protects electrical switches.
Figure 8:
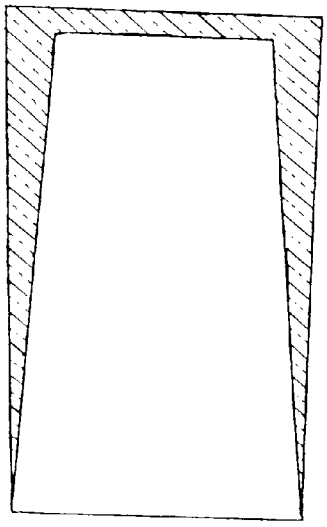
FIG. 8 illustrates the tap-ring width of the side wall of the doorknob protector.
Figure 9:
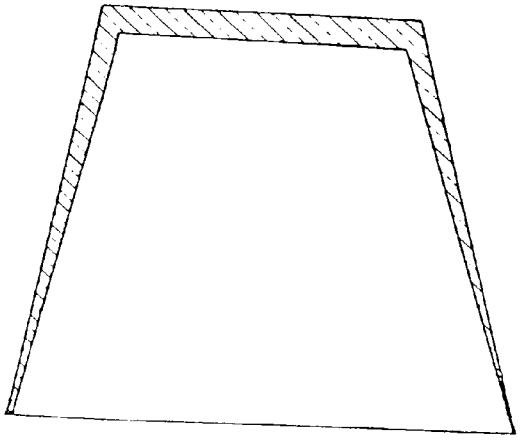
FIG. 9 illustrates the tapering width of the side wall of the dead bolt protector.
Figure 10:
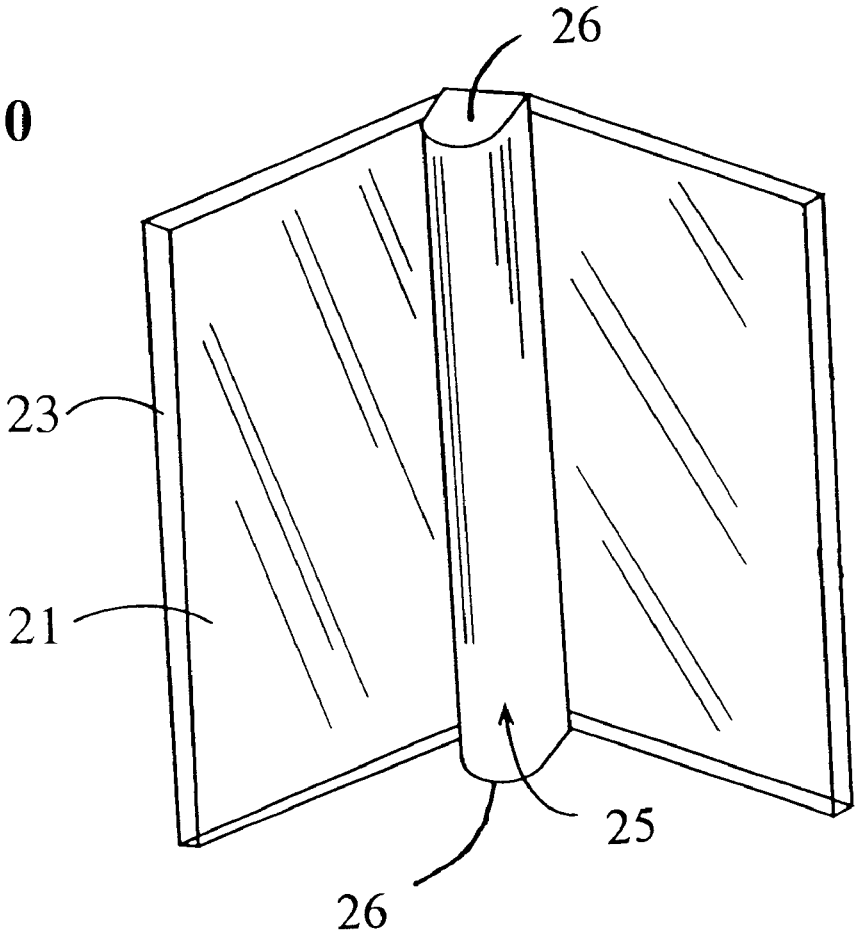
FIG. 10 illustrates the enclosure formed by the longitudinal section.

In a sixth embodiment of the present invention, as seen in FIG. 6, mask 6 is a first form of a device which protects wall electrical hardware. The device 6 comprises a one piece cover 60 which an open end. The open end fits over the wall electrical hardware. Preferably, the one piece cover 60 is formed in the shape of an open box having a rectangular flat front 61 and four sides 62 which are attached along all four edges of the flat rectangular front 61 and joint together at converging comers 63. In this second form of the device which protects wall electrical hardware, there is, attached on an inner side 64 of the rectangular flat front 61, attachment means 68 such as at least one pair of, but preferably two pair of, substantially parallel prongs 65 which are adapted and sized to fit within the electrical prong openings 66 on the exposed wall electrical hardware. It is critical that these prongs 65 be constructed of an insulating material such as plastic to prevent electrical shock. The face plate of the wall electrical hardware is removed by unscrewing the securing screw. The remaining exposed wall electrical hardware is protected by fitting the prongs 65 of the device 6 within the electrical prong openings 66.

An alternate form of the sixth embodiment of the present invention is a simple rectangularly shaped piece 67 which is dimensioned slightly smaller than an electrical outlet box. An attachment means 68, such as at least one pair of, but preferably two, substantially parallel prongs 65 which are adapted and sized to fit within the electrical prong openings 66 on the exposed wall electrical hardware, is affixed to one side of the rectangularly shaped piece 67. While the above two forms of the sixth embodiment are described for use with a dual plug outlet, they may be adapted to be used with more than dual plug outlet, such as quadruple plugs or the like.

In a seventh embodiment of the present invention, mask 7 protects wall electrical switches. The mask 7 comprises a one piece cover 70 which an open end. The open end substantially fits over the wall electrical switch. Preferably, the one piece cover 70 is formed in the shape of the electrical switch. The face plate of the wall electrical switch is removed by unscrewing the securing screws. The remaining exposed portion of the hardware is protected by fitting the mask 70 over the electrical switch.

In an eighth embodiment of the present invention, a kit 8 is provided which contains several devices each of which protects a separate piece of room or door hardware. Specifically, door hinge pin barrels, door hinge butt plates, door knobs, door dead bolt hardware and wall electrical hardware are protected by the devices of the kit 7. The kit 7 is comprised of mask 1 and mask 2, mask 3, mask 4, mask 5, mask 6 and mask 7, in combination. Moreover, all of the various sub-combinations of the seven devices recited are considered alternate forms of kit 7 and fall within the scope of the present invention.

It can be seen that the above described embodiments are intended to be reusable devices, which may be used in any number of rooms sequentially. Furthermore, the described embodiments may be affixed to the hardware by alternate means such as pressure sensitive adhesives applied to surfaces which would be adjacent to the masked hardware.

While these descriptions directly describe the above embodiments, it is understood that those skilled in the art may conceive modifications and/or variations to the specific embodiments shown and described herein. Any such modifications or variations which fall within the purview of this description are intended to be included therein as well. It is understood that the description herein in intended to be illustrative only and is not intended to be limitative. Rather, the scope of the invention described herein is limited only by the claims appended hereto.

What is claimed is:

1. A device for protecting door dead bolt hardware from paint contamination comprising a substantially cup shaped covering with a side wall having a thickness that tapers from a second end to a first end to form a fine edges, said cup shaped covering having an opening for admitting door dead bolt hardware.

2. The device of claim 1 wherein the substantially cup shaped covering further comprises a substantially cylindrically shaped side wall and the second end is covered by an end piece.

3. The device of claim 1 wherein the cup shaped covering is shaped as a frustum, wherein the first end has a larger diameter than the second end.

4. A device for protecting door knob hardware from paint contamination comprising a substantially cup shaped covering with a side wall having a thickness that tapers from a second end to a first end to form a fine edge, said cup shaped covering having an opening at the first end for admitting door knob hardware.

5. The device of claim 4 wherein the side wall of the substantially cup shaped covering further comprises a substantially cylindrically shaped side wall having the second end covered by an end piece.

6. The device of claim 4 wherein the cup shaped covering is shaped as a frustum, wherein the first end has a larger diameter than the second end.

7. A kit for protecting hardware from paint contamination comprising:

A) a device for protecting door hinge pin barrels from paint contamination comprising a longitudinal section that forms an enclosure with a door hinge pin barrel entrance channel, wherein the longitudinal second tapers in width to form a fine edge at the door hinge pin barrel entrance channel;

B) a device for protecting door hinge butt plates from paint contamination comprising:

i) a longitudinal section that forms an enclosure of a portion of a door hinge pin barrel and has a pin barrel opening;

ii) first and second butt plate covers, each of which are flexibly attached to the longitudinal section near the pin barrel opening; and C) a device for protecting door dead bolt hardware from paint contamination comprising a substantially cup shaped covering with a side wall having a thickness that tapers from a second end to a first end to form a fine edge, said cup shaped covering having an opening for admitting door dead bolt hardware.

8. The kit of claim 7 further comprising a device for protecting door knob hardware from paint contamination comprising a substantially cup shaped covering with a side wall having a thickness that tapers from a second end to a first end to form a fine edie, said cup shaped covering having an opening for admitting door knob hardware.

* * * * *